US006528469B2

(12) United States Patent
Reinehr et al.

(10) Patent No.: US 6,528,469 B2
(45) **Date of Patent: *Mar. 4, 2003**

(54) FABRIC BLEACHING COMPOSITION

(75) Inventors: Dieter Reinehr, Kandern (DE); Georges Metzger, Moernach (DE)

(73) Assignee: Ciba Specialty Chemicals Corporation, Tarrytown, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/077,047

(22) PCT Filed: Nov. 5, 1996

(86) PCT No.: PCT/EP96/04812

§ 371 (c)(1),
(2), (4) Date: Oct. 13, 1998

(87) PCT Pub. No.: WO97/19162

PCT Pub. Date: May 29, 1997

(65) Prior Publication Data

US 2001/0003737 A1 Jun. 14, 2001

(30) Foreign Application Priority Data

Nov. 18, 1995 (GB) ..... 9523654

(51) Int. Cl.[7] ..... C11D 3/00; C11D 7/18; C11D 7/54

(52) U.S. Cl. ..... 510/303; 510/305; 510/311; 510/312; 510/370; 510/371; 510/372; 510/374; 510/376; 510/378; 8/111; 8/137; 252/186.33

(58) Field of Search ..... 510/303, 304, 510/305, 311, 312, 370, 371, 372, 374, 376, 378; 252/186.26, 186.27, 186.29, 186.31, 186.32, 186.33; 8/111, 137

(56) References Cited

U.S. PATENT DOCUMENTS

| | | | | |
|---|---|---|---|---|
| 4,655,785 A | | 4/1987 | Reinert et al. | 8/442 |
| 5,114,606 A | | 5/1992 | van Vliet et al. | 252/103 |
| 5,114,611 A | | 5/1992 | Van Kralingen et al. | 252/186.33 |
| 5,733,341 A | * | 3/1998 | Eckhardt et al. | 8/111 |

FOREIGN PATENT DOCUMENTS

| | | |
|---|---|---|
| EP | 0392592 | 10/1990 |
| EP | 0544490 | 6/1993 |
| EP | 0630964 | 12/1994 |
| EP | 0693550 | 1/1996 |
| EP | 0717103 | 6/1996 |

* cited by examiner

*Primary Examiner*—Gregory Delcotto
(74) *Attorney, Agent, or Firm*—Kevin T. Mansfield

(57) ABSTRACT

A fabric bleaching composition comprising a peroxy compound and a specified manganese compound is disclosed, as well as a process for bleaching and/or cleaning a fabric by contacting it with said fabric bleaching composition.

27 Claims, No Drawings

FABRIC BLEACHING COMPOSITION

The present invention relates to fabric bleaching compositions comprising a peroxygen compound and, as bleach activator, a manganese compound.

Bleaching compositions which contain a peroxide bleaching agent are well-known. When soiled clothing is contacted with such bleaching compositions, usually by washing the soiled clothing in the presence of the bleaching composition at the boil, the bleaching agent functions to remove such common domestic stains as tea, coffee, fruit and wine stains from clothing. If the washing temperature is reduced to below 60° C., however, the efficacy of the the bleaching agent is correspondingly reduced.

It is also well-known that certain heavy metals, or complexes thereof, function to catalyze the decomposition of hydrogen peroxide, or of compounds which are capable of liberating hydrogen peroxide, in order to render the peroxide compound effective at temperatures below 60° C.

For example, in U.S. Pat. No. 5,114,511, there is described the activation of a peroxy compound by a complex formed from a transition metal (Mn, Co, Fe or Cu) and a non-(macro)cyclic ligand, preferably 2,2-bispyridylamine or 2,2-bispyridylmethane.

Moreover, in U.S. Pat. No. 5,114,606, there is disclosed a manganese complex, for use as a bleach catalyst for a peroxy compound, which is a water-soluble complex of manganese II, III or IV, or mixtures thereof, with a ligand which is a non-carboxylate polyhydroxy compound, having at least three consecutive C—OH groups in its molecular structure, preferably sorbitol.

It has now been found that certain other manganese compounds are also excellent bleach catalysts for peroxy compounds and, surprisingly, relative to known bleach catalysts, provide enhanced bleach effects at low wash temperatures (e.g. at 15 to 40° C.) and/or using shorter washing times.

Accordingly, the present invention provides a fabric bleaching composition comprising a) a peroxy compound; and b) 0.0005 to 0.5, preferably 0.005 to 0.05%, by weight of manganese, of a manganese compound having one of the formulae:

(1)

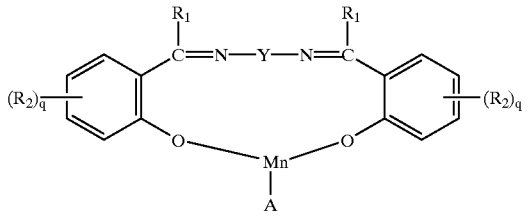

(2)

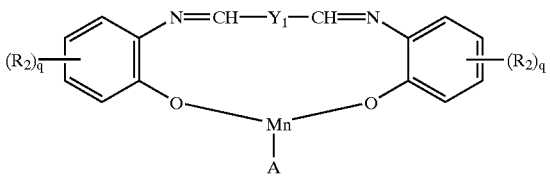

-continued (3)

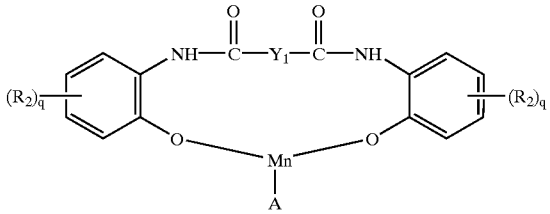

(4)

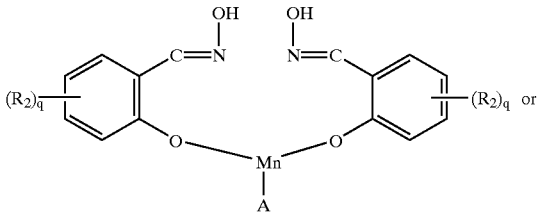

(5)

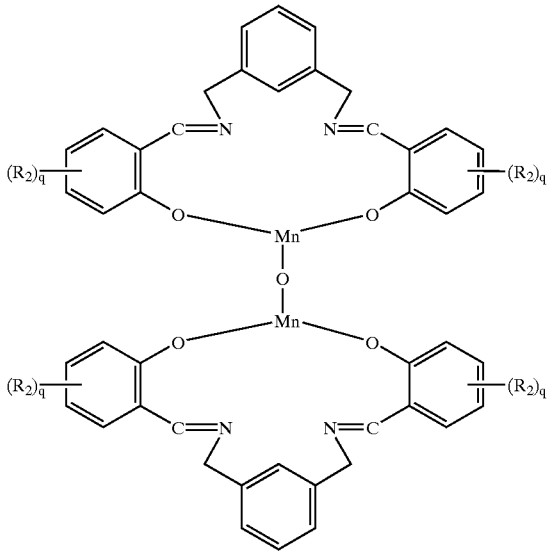

in which $R_1$ is hydrogen, alkyl, cycloalkyl or aryl; $R_2$ is hydrogen, alkyl, alkoxy, halogen, cyano, NH(alkyl), $N(alkyl)_2$, $N^{\oplus}(alkyl)_3$, $SO_3M$, COOM or hydroxy; Y is a direct bond, a $C_2$–$C_8$-alkylene residue which is substituted or interrupted by one or more aryl or arylene groups, especially phenyl or phenylene groups, or Y is a bicyclic cyclohexylene group, especially

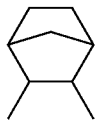

or arylene, preferably naphthalene or, especially, o-, m- or p-phenylene, or Y is a residue having the formula:

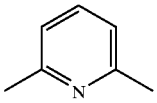

;

$Y_1$ is o-, m- or p-phenylene; M is hydrogen, an alkali metal atom, ammonium or a cation formed from an amine; q is 0, 1, 2 or 3; and A an anion.

When $R_1$ or $R_2$ is alkyl, preferred alkyl groups are $C_1$–$C_{12}$-, especially $C_1$–$C_4$-alkyl groups. The alkyl groups may be unbranched or branched.

Alkoxy groups $R_2$ are preferably $C_1$–$C_8$-, especially $C_1$–$C_4$-alkoxy groups. The alkoxy groups may be unbranched or branched.

Halogen atoms $R_2$ are preferably bromo or, especially, chloro atoms.

N(optionally substituted alkyl)$_2$ groups $R_2$ are preferably N(optionally substituted $C_1$–$C_4$alkyl)$_2$ groups, especially N(methyl)$_2$ or N(ethyl)$_2$.

$N^{\oplus}$(optionally substituted alkyl)$_3$ groups $R_2$ are preferably $N^{\oplus}$(optionally substituted $C_1$–$C_4$alkyl)$_3$, especially $N^{\oplus}$(methyl)$_3$ or $N^{\oplus}$(ethyl)$_3$.

When $R_1$ is cycloalkyl, it is preferably cyclopentyl or cyclohexyl.

When $R_1$ is aryl, it is preferably a phenyl or naphthyl group. Any aryl group $R_1$ or any aryl group which is a component of a group Y may be substituted e.g. by $C_1$–$C_4$-alkyl, such as methyl, ethyl, propyl, isopropyl, butyl, isobutyl, sec.-butyl or tert.-butyl, by $C_1$–$C_4$-alkoxy such as methoxy, ethoxy, propoxy, isopropoxy, butoxy, isobutoxy, sec.-butoxy or tert.-butoxy, by halogen such as fluorine, chlorine or bromine, by $C_2$–$C_5$-alkanoyl, by benzoyl, by C2–C5-alkanoylamino, such as acetylamino, propionylamino or butyrylamino, by nitro, $SO_3M$, $CO_2M$, in which M has its previous significance, or by di-$C_1$–$C_4$alkyl amino.

When Y is a $C_2$–$C_8$-alkylene residue which is substituted or interrupted by one or more aryl or arylene groups, especially phenyl or phenylene groups, examples of preferred groups Y of this type include groups having the formula:

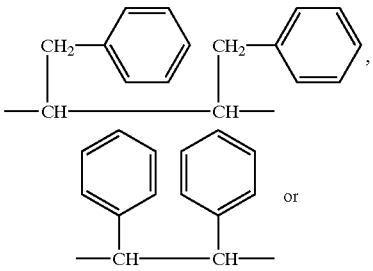

—$CH_2$—(o-, m- or p- )phenylene-$CH_2$—.

Anions A include halide, especially chloride, chlorate, sulphate, nitrate, hydroxy, $C_1$–$C_4$alkoxy, preferably methoxy, $BF_4$, $PF_6$, $C_1$–$C_4$carboxylate, especially acetate, or triflate or tosylate.

With respect to the compounds of formula (1), preferably each $R_1$ is hydrogen, $R_2$ is hydrogen, OH or $SO_3M$ in which M has its previous significance and is preferably Na, q is 1, Y is a direct bond, $C_2$–$C_8$-alkylene interrupted or substituted by optionally substituted o-, m- or p-phenylene, a bicyclic cyclohexylene group or Y is optionally substituted o-, m- or p-phenylene and A is hydroxy.

In relation to the compounds of formula (2), preferably each $R_1$ is hydrogen, $R_2$ is hydrogen, OH or $SO_3M$ in which M has its previous significance and is preferably Na, q is 0 or 1 and A is hydroxy.

With regard to the compounds of formula (3), (4) or (5), preferably each $R_2$ is hydrogen, OH or $SO_3M$ in which M has its previous significance and is preferably Na and q is 0 or 1 and for the compounds of formula (3) or (4), A is hydroxy.

In each of the compounds of formula (1) to (5), it is preferred that they are used in neutral form, i.e. that M, when present, is other than hydrogen, preferably a cation formed from an alkali metal, in particular sodium, or from an amine.

The compounds of formula (1) to (5) may be produced by known methods, e.g. by the methods analogous to those disclosed in U.S. Pat. No. 4,655,785 relating to similar copper compounds.

The peroxy component a) of the fabric bleaching compositions of the present invention may be hydrogen peroxide, a compound which liberates hydrogen peroxide, a peroxyacid, a peroxyacid bleach precursor or a mixture thereof.

Compounds which liberate hydrogen peroxide are well known and include, e.g., inorganic compounds such as alkali metal peroxides, -perborates, -percarbonates, -perphosphates and -persulfates and organic compounds such as peroxylauric acid, peroxybenzoic acid, 1,12-diperoxydodecanoic acid, diperoxyisophthalic acid and urea peroxide, as well as mixtures thereof. Sodium percarbonate and sodium perborate, in particular sodium perborate monohydrate, are preferred.

Peroxyacid compounds and peroxyacid bleach precursors are also well known and a summary of references describing them is provided in the above-mentioned U.S. Pat. No. 5,114,606.

Examples of peroxyacid bleach precursors include benz(4H)-1,3-oxazin-4-one derivatives, especially substituted 2-phenyl-benz(4H)-1,3-oxazin-4-one 2-(N,N,N-trimethyl ammonium) ethyl sodium-4-sulfophenyl carbonate chloride (SPCC)

N-octyl,N,N-dimethyl-N10-carbophenoxy decyl ammonium chloride (ODC)

3-(N,N,N-trimethyl ammonium) propyl sodium 4-sulfophenyl carboxylate

N,N,N-trimethyl ammonium toluyloxy benzene sulfonate sodium4-benzoyloxy benzene sulfonate (SBOBS)

N,N,N',N'-tetraacetyl ethylene diamine (TAED)

sodium-1-methyl-2-benzoyloxy benzene-4-sulfonate sodium-4-methyl-3-benzoyloxy benzoate and sodium nonanoyloxybenzene sulfonate (NOBS).

The substituted 2-phenyl-benz(4H)-1,3-oxazin-4-one, NOBS and TAED precursors are preferred.

Preferably, the amount of the peroxy compound in the fabric bleaching composition according to the invention ranges from 0.5 to 50%, especially from 2 to 20% by weight, based on the total weight of the composition.

The fabric bleaching compositions of the present invention preferably also comprises a surfactant and a detergent builder component.

The surfactant component is preferably an anionic surfactant, a nonionic surfactant or a mixture thereof and is preferably present in an amount of 5 to 50%, especially 5 to 25% by weight, based on the total weight of the fabric bleaching composition.

The anionic surfactant component may be, e.g., a sulphate, sulphonate or carboxylate surfactant, or a mixture of these.

Preferred sulphates are alkyl sulphates having 12–22 carbon atoms in the alkyl radical, optionally in combination with alkyl ethoxy sulphates having 10–20 carbon atoms in the alkyl radical.

Preferred sulphonates include alkyl benzene sulphonates having 9–15 carbon atoms in the alkyl radical.

In each case, the cation is preferably an alkali metal, especially sodium.

Preferred carboxylates are alkali metal sarcosinates of formula $R—CO(R^1)CH_2COOM^1$ in which R is alkyl or alkenyl having 9–17 carbon atoms in the alkyl or alkenyl radical, $R^1$ is $C_1$–C4 alkyl and $M^1$ is alkali metal.

The nonionic surfactant component may be, e.g., a condensate of ethylene oxide with a $C_9$–C15 primary alcohol having 3–8 moles of ethylene oxide per mole.

The detergent builder component is preferably present in an amount of 5 to 80%, especially 10 to 60% by weight, based on the total weight of the fabric bleaching composition. It may be an alkali metal phosphate, especially a tripolyphosphate; a carbonate or bicarbonate, especially the sodium salts thereof; a silicate; an aluminosilicate; a polycarboxylate; a polycarboxylic acid; an organic phosphonate; or an aminoalkylene poly (alkylene phosphonate); or a mixture of these.

Preferred silicates are crystalline layered sodium silicates of the formula $NaHSi_mO_{2m+1}.pH_2O$ or $Na_2Si_mO_{2m+1}.pH_2O$ in which m is a number from 1.9 to 4 and p is 0 to 20.

Preferred aluminosilicates are the commercially-available synthetic materials designated as Zeolites A, B, X, and HS, or mixtures of these. Zeolite A is preferred.

Preferred polycarboxylates include hydroxypolycarboxylates, in particular citrates, polyacrylates and their copolymers with maleic anhydride.

Preferred polycarboxylic acids include nitrilotriacetic acid and ethylene diamine tetra-acetic acid.

Preferred organic phosphonates or aminoalkylene poly (alkylene phosphonates) are alkali metal ethane 1-hydroxy diphosphonates, nitrilo trimethylene phosphonates, ethylene diamine tetra methylene phosphonates and diethylene triamine penta methylene phosphonates.

The fabric bleaching compositions of the invention preferably also contain one or more agents capable of binding manganese, in particular an aminocarboxylate, an aminophosphonate, a polyamine or a mixture of these. Examples of aminocarboxylates include ethylenediaminetetraacetate, N-hydroxyethylenediaminetriacetate, nitrilotriacetate, ethylenediaminetetrapropionate, triethylenetetraaminehexaacetate, diethylenetriaminepentaacetate, ethylenediaminedisuccinate, especially the S,S isomer, and ethanoldiglycine, each in their acid forms or as the respective alkali metal, ammonium or substituted ammonium salts, as well as mixtures thereof. Examples of aminophosphonates include diethylenetriaminepentamethylene phosphonic acid and salts thereof. Examples of polyamines are, e.g., diethylenetriamine, pentamethyidiethylenetriamine, 1,1',7,7'-tetramethyl-4-hydroxymethyl-diethylenetriamine and 1,4,4'-trimethyl-1'-hydroxymethyl-ethylenediamine. Most preferred agents capable of binding manganese are diethylenetriaminepentamethylene phosphonic acid, diethylenetriaminepentaacetic acid, triethylenetetraaminehexaacetic acid and salts thereof, and diethylenetriamine.

The agent capable of binding manganese is generally present in an amount of 0.1 to 10%, preferably from 0.1 to 3% by weight, based on the weight of the fabric bleaching composition.

The presence of the agent capable of binding manganese in the fabric bleaching compositions of the invention has the desired effect of reducing any fabric damage which may be caused by the use of the manganese compounds of formula (1) to (5).

The fabric bleaching compositions of the invention may contain, in addition to the components already mentioned, one or more of fluorescent whitening agents, such as a bis-triazinylamino-stilbene-disulphonic acid, a bis-triazolyl-stilbene-disulphonic acid, a bis-styryl-biphenyl, a bis-benzofuranylbiphenyl, a bis-benzoxalyl derivative, a bis-benzimidazolyl derivative, a coumarine derivative or a pyrazoline derivative; soil suspending agents, for example sodium carboxymethylcellulose; salts for adjusting the pH, for example alkali or alkaline earth metal silicates; foam regulators, for example soap; salts for adjusting the spray drying and granulating properties, for example sodium sulphate; perfumes; and also, if appropriate, antistatic and softening agents; such as smectite clays; enzymes, such as proteases, cellulases, lipases, oxidases and amylases; photobleaching agents; pigments; and/or shading agents. These constituents should, of course, be stable to the bleaching system employed.

A particularly preferred fabric bleaching composition co-additive is a polymer known to be useful in preventing the transfer of labile dyes between fabrics during the washing cycle. Preferred examples of such polymers are polyvinyl pyrrolidones, optionally modified by the inclusion of an anionic or cationic substituent, especially those having a molecular weight in the range from 5000 to 60,000, in particular from 10,00 to 50,000. Preferably, such polymer is used in an amount ranging from 0.05 to 5%, preferably 0.2–1.7% by weight, based on the weight of the detergent.

The formulation of the fabric bleaching compositions of the invention may be conducted by any conventional technique.

The fabric bleaching composition may be formulated as a solid; or as a non-aqueous liquid fabric bleaching composition, containing not more than 5, preferably 0–1 wt. % of water, and based on a suspension of a builder in a non-ionic surfactant, as described, e.g., in GB-A-2158454.

Preferably, the fabric bleaching composition is in powder or granulate form.

Such powder or granulate forms may be produced by firstly forming a base powder by spray-drying an aqueous slurry containing all the said components , apart from the components a) and b); then adding the components a) and b) by dry-blending them into the base powder. In a further process, the component b) may be added to an aqueous slurry containing the surfactant and builder components, followed by spray-drying the slurry prior to dry-blending component a) into the mixture. In a still further process, a nonionic component is not present, or is only partly present in an aqueous slurry containing anionic surfactant and builder components; component b) is incorporated into the nonionic surfactant component, which is then added to the spray-dried base powder; and finally component a) is dry-blended into the mixture.

The present invention also comprises a bleaching and/or cleaning process comprising contacting a fabric to be bleached and/or cleaned with an effective amount of a fabric bleaching composition according to the present invention. Preferably the amount of the fabric bleaching composition used is such that the amount of manganese compound b) provides from 0.001 to 100 ppm, preferably from 0.01 to 20 ppm of manganese in the bleaching and/or cleaning bath.

The following Examples serve to illustrate the invention; parts and percentages are by weight, unless otherwise stated.

EXAMPLE 1

(101)

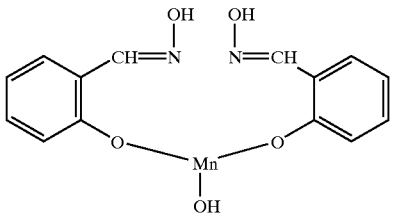

2.01 g. of Mn(II)-acetate.$4H_2O$ and 1.21 g. of hydroxylamine hydrochloride are dissolved in 10 ml. of water and treated, dropwise, at 20° C., with a solution of 2.13 g. of salicylaldehyde in 17.5 ml. of 1N NaOH. There are then added to the reaction solution a further 17.5 ml. of 1N NaOH solution followed by 200 ml. of ethyl alcohol. After stirring for 1 hour at 80° C., the reaction solution is cooled, most of the ethyl alcohol is distilled off and the reaction solution is filtered. After drying, there are obtained 1.97 g. of a dark brown powder, corresponding to a yield of 67% of theory.

Elemental analysis of the compound having the formula (101) and having the empirical formula $C_{14}H_{13}MnN_2O5$ gives: Req.% C 48.85; H 3.81; N 8.13; Mn 15.96. Found % C 48.44; H 3.82; N 8.07; Mn 16.20.

EXAMPLE 2

Using a procedure similar to that described in Example 1, the compound having the formula (102) is obtained:

(102)

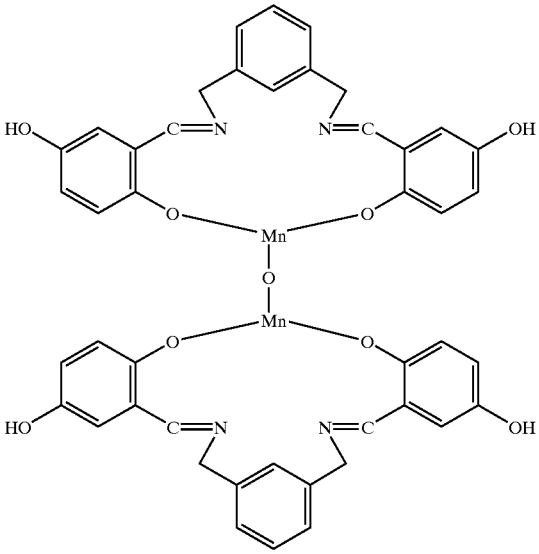

Elemental analysis of the compound having the formula (102) and having the empirical formula $C_{44}H_{36}Mn_2N_2O_{10}.8H_2O$ gives: Req.% C 51.07; H 5.06; N 5.41; Mn 10.61; O 27.83. Found % C 51.18; H 4.35; N 5.48; Mn 10.3; O 28.69.

EXAMPLE 3

Using a procedure similar to that described in Example 1, the compound having the formula (103) is obtained:

(103)

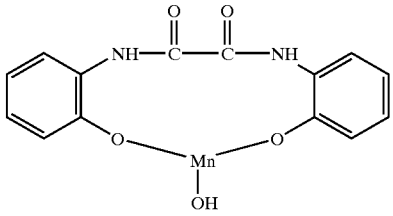

Elemental analysis of the compound having the formula (103) and having the empirical formula $C_{14}H_{11}MnN_2O_5.1.5H_2O$ gives: Req.% C 45.54; H 3.82; N 7.58; Mn 14.80. Found % C 45.57; H 4.04; N 7.63; Mn 13.70.

EXAMPLE 4

Using a procedure similar to that described in Example 1, the compound having the formula (104) is obtained:

(104)

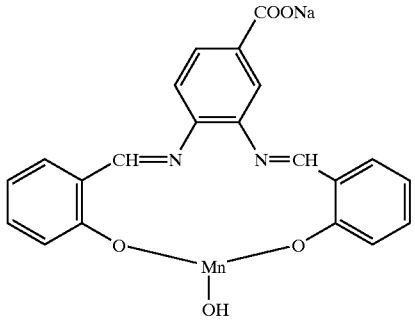

Elemental analysis of the compound having the formula (104) and having the empirical formula $C_{21}H_{14}MnN_2NaO_5.2.5H_2O$ gives: Req.% C 50.72; H 3.85; N 5.63; Mn 12.04; O 24.1. Found % C 50.74; H 3.54; N 5.67; Mn 12.9; O 24.2.

EXAMPLE 5

Using a procedure similar to that described in Example 1, the compound having the formula (105) is obtained in a yield of 72% of theory:

(105)

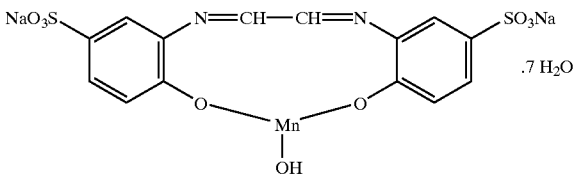

Elemental analysis of the compound having the formula (105) and having the empirical formula $C_{14}H_9MnN_2Na_2O_9S_2.7H_2O$ gives: Req.% C 26.27; H 3.62; N 4.37; S 10.01; Mn 8.58; Na 7.8; $H_2O$ 19.68. Found % C 25.9; H 3.5; N 4.3; S 9.8; Mn 9.1; Na 7.03; $H_2O$ 19.95.

EXAMPLE 6

Using a procedure similar to that described in Example 1, the compound having the formula (106) is obtained in a yield of 75% of theory:

(106)

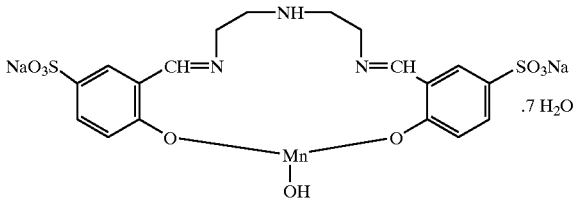

Elemental analysis of the compound having the formula (106) and having the empirical formula $C_{18}H_{18}MnN_3Na_2O_9S_2.7H_2O$ gives: Req.% C 30.38; H 4.53; N 5.9; S 9.01; Mn 7.72; $H_2O$ 17.7. Found % C 30.52; H 4.48; N 5.96; S 8.98; Mn 7.36; $H_2O$ 18.17.

EXAMPLES 7 AND 8

A standard (ECE) washing powder is made up from the following components in the indicated proportions:

8.0% Sodium ($C_{11.5}$)alkylbenzenesulphonate;

2.9% Tallow-alcohol-tetradecane-ethyleneglycolether (14 moles EO);

3.5% Sodium soap;

43.8% Sodium triphosphate;

7.5% Sodium silicate;

1.9% Magnesium silicate;

1.2% Carboxymethylcellulose;

0.2% EDTA;

21.2% Sodium sulphate; and 9.8% Water.

An aqueous wash liquid is then made up and contains 7.5 g/l of the ECE powder, 1.13 g/l of sodium perborate monohydrate and 0.015 g/l of the compound of formula (101) as described in Example 1 or 0.015 g/l of the compound of formula (105) as described in Example 5.

Into 400 ml of the aqueous wash liquid (made up using town water of 12 degrees of hardness), there are placed 12.5 g. of test cotton fabric soiled with tea stains, as well 37.5 g. of bleached cotton (i.e. giving a liquor ratio of 1:8).

The respective wash baths are each heated from 15° C. to the test temperature of 40° C. over a period of 10 minutes; and held at the test temperature for a further 10 minutes. The respective swatches are then rinsed under flowing, cold town water, spun dry and ironed.

The brightness value (Y) of the respective test swatches is then determined using an ICS SF 500 spectrophotometer. The value Y provides a measure of the level of bleach effect achieved. A difference of 1 Y unit is clearly detectable visually.

For reference purposes, the respective Y values are determined for each of the washed goods at 40° C. using perborate alone (i.e. using no compound of formula 101 or 105).

The results obtained are set out in the following Table.

TABLE

| | | ΔY | |
|---|---|---|---|
| Example | Test Compound | 15% perborate | 15% perborate + 0.2% test cpd. |
| 7 | (101) | Y = 0 | Y = 15.0 |
| 8 | (105) | Y = 0 | Y = 14.9 |

It is clear from the results in the Table that the bleaching improvement achieved with a fabric bleaching composition according to the invention is 15 times greater than that using perborate alone.

We claim:

1. A method of bleaching fabrics, which comprises incorporating in a bleaching bath a bleaching effective amount of a composition comprising a) 0.5 to 50% by weight, based on the total weight of-the composition of a peroxy compound; and b) 0.0005 to 0.5%, by weight of manganese, of one or more manganese compounds having one of the formulae (1), (4):

(1)

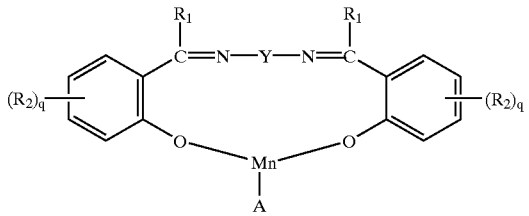

(4)

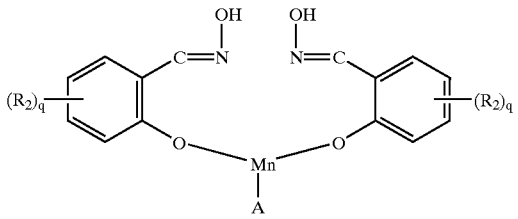

in which $R_1$ is hydrogen, alkyl cycloalkyl or aryl; $R_2$ is hydrogen, alkyl, alkoxy, halogen, cyano, NH(alkyl), N(alkyl)$_2$, $N^{\oplus}$(alkyl)$_3$, COOM or hydroxy and, in the formulae (4), $R_2$ is also $SO_3M$; Y is a direct bond, a $C_2$–$C_8$-alkylene residue which is substituted or interrupted by one or more aryl or arylene groups, —$CH_2CH_2$—NH—$CH_2CH_2$— or Y is a bicyclic cyclohexylene group of the formula

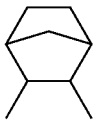

or an arylene residue, or Y is a residue having the formula:

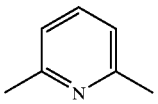

;

$Y_1$ is o-, m- or p-phenylene; M is hydrogen, an alkali metal atom, ammonium or a cation formed from an amine; and q is 0, 1, 2 or 3;

and A is hydroxy.

2. A method according to claim 1 in which Y is a $C_2$–$C_8$-alkylene residue which is substituted or interrupted by one or more phenyl or phenylene groups.

3. A method according to claim 1 in which Y is

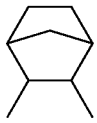

.

4. A method according to claim 1 in which Y is o-, m- or p-phenylene.

5. A method according to claim 1 in which a compound of formula (1) is present in which each $R_1$ is hydrogen, $R_2$ is hydrogen or OH, q is 1, Y is a direct bond, $C_2$–$C_8$-alkylene interrupted or substituted by optionally substituted o-, m- or p-phenylene, a bicyclic cyclohexylene group of the formula

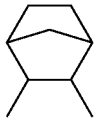

or Y is optionally substituted o-, m- or p-phenylene and A is hydroxy.

6. A method according to claim 1 in which a compound of formula (3), (4) or (5) is present and each $R_2$ is hydrogen, OH or $SO_3M$ in which M is as defined in claim 1, q is 0 or 1 and A is hydroxy.

7. A method according to claim 1 in which the peroxy component a) is hydrogen peroxide, a compound which liberates hydrogen peroxide, a peroxyacid, a peroxyacid bleach precursor or a mixture thereof.

8. A method according to claim 7 in which the compound which liberates hydrogen peroxide is an alkali metal peroxide, -perborate, -percarbonate, -perphosphate or -persulfate; peroxylauric acid, peroxybenzoic acid, diperoxyisophthalic acid, 1,12-diperoxydodecanedioic acid or urea peroxide; or a mixture thereof.

9. A method according to claim 8 in which the compound which liberates hydrogen peroxide is sodium percarbonate or sodium perborate.

10. A method according to claim 7 in which the peroxyacid bleach precursor is a benz(4H)-1,3-oxazin-4-one derivative, 2-(N,N,N-trimethyl ammonium) ethyl sodium-4-sulfophenyl carbonate chloride (SPCC), N-octyl,N,N-dimethyl-N10-carbophenoxy decyl ammonium chloride (ODC), 3-(N,N,N-trimethyl ammonium) propyl sodium 4-sulfophenyl carboxylate, N,N,N-trimethyl ammonium toluyloxy benzene sulfonate, sodium-4-benzoyloxy benzene sulfonate (SBOBS), N N,N',N'-tetraacetyl ethylene diamine (TAED), sodium-1-methyl-2-benzoyloxy benzene-4-sulfonate, sodium-4-methyl-3-benzoyloxy benzoate or sodium nonanoyloxybenzene sulfonate (NOBS).

11. A method according to claim 10 in which the peroxyacid bleach precursor is a substituted 2-phenyl-benz(4H)-1,3-oxazin-4-one, sodium nonanoyloxybenzene sulfonate or N,N,N',N'-tetraacetyl ethylene diamine.

12. A method according to claim 1 in which the amount of the peroxy compound is 2 to 20% by weight, based on the total weight of the composition.

13. A method according to claim 1 in which the composition comprises also one or more agents capable of binding manganese.

14. A method according to claim 13 in which the agent capable of binding manganese is an aminocarboxylate, an aminophosphonate, a polyamine or a mixture of these.

15. A method according to claim 13 in which the agent capable of binding manganese is diethylenetriaminepentamethylene phosphonic acid, diethylenetriaminepentaacetic acid, triethylenetetraaminehexaacetic acid or a salt thereof, or diethylenetriamine.

16. A method according to claim 13 in which the agent capable of binding manganese is present in an amount of 0.1 to 10%, based on the weight of the fabric bleaching composition.

17. A method according to claim 1 in which the composition comprises also a protease, cellulase, lipase, oxidase or amylase enzyme.

18. A method according to claim 1 in which the composition is in powder or granulate form.

19. A method according to claim 1, in which the composition is in liquid form and contains 0–5% water.

20. A method according to claim 19, in which the composition is in liquid form and contains 0–1% water.

21. A method according claim 18, in which the composition is prepared by mixing the components in dry form.

22. A method according to claim 18, in which the composition according to claim 18 is prepared by a process in which a base powder is produced by spray-drying an aqueous slurry which contains all the components, apart from the components a) and b); then adding the components a) and b) by dry-blending them into the base powder.

23. A method according to claim 18, in which the composition according to claim 18 is prepared by a process in which the component b) is added to an aqueous slurry containing surfactant and builder components, followed by spray-drying the slurry prior to dry-blending component a) into the mixture.

24. A method according to claim 23, in which a nonionic surfactant component is not present, or is only partly present in an aqueous slurry containing anionic surfactant and builder components; component b) is incorporated into the nonionic surfactant component, which is then added to the spray-dried base powder; and finally component a) is dry-blended into the mixture.

25. A method according to claim 1 in which the amount of the fabric bleaching composition used is such that the amount of manganese compound b) provides from 0.001 to 100 ppm of manganese in the bleaching and/or cleaning bath.

26. A method according to claim 25 in which the amount of the fabric bleaching composition used is such that the amount of manganese compound b) provides from 0.01 to 20 ppm of manganese in the bleaching and/or cleaning bath.

27. A fabric bleaching composition comprising a) 0.5 to 50% by weight, based on the total weight of the composition of a peroxy compound; and b) 0.005 to 0.05% by weight of manganese, based on the total weight of the composition of a manganese compound having the formula (4)

(4)

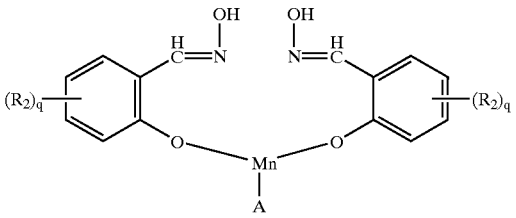

in which $R_2$ is hydrogen, alkyl, alkoxy, halogen, cyano, NH(alkyl), $N(alkyl)_2$, $N^{\oplus}(alkyl)_3$, $SO_3M$, COOM or hydroxy; M is hydrogen, an alkali metal atom, ammonium or a cation formed from an amine; and A is hydroxy.

* * * * *

UNITED STATES PATENT AND TRADEMARK OFFICE

CERTIFICATE OF CORRECTION

PATENT NO. : 6,528,469 B2
DATED : March 4, 2003
INVENTOR(S) : Dieter Reinehr et al.

It is certified that error appears in the above-identified patent and that said Letters Patent is hereby corrected as shown below:

Title page,
Item [75], the second inventor's residence should read -- Moernach (FR) --.

Signed and Sealed this

Twenty-second Day of July, 2003

JAMES E. ROGAN
*Director of the United States Patent and Trademark Office*